United States Patent [19]

Toyota

[11] Patent Number: 4,808,940

[45] Date of Patent: Feb. 28, 1989

[54] ELECTRIC BEAM ACCELERATOR

[75] Inventor: Eijiro Toyota, Tokyo, Japan

[73] Assignee: Sumitomo Heavy Industries, Ltd., Tokyo, Japan

[21] Appl. No.: 54,595

[22] PCT Filed: Sep. 10, 1986

[86] PCT No.: PCT/JP86/00458

§ 371 Date: May 12, 1987

§ 102(e) Date: May 12, 1987

[87] PCT Pub. No.: WO87/01556

PCT Pub. Date: Mar. 12, 1987

[30] Foreign Application Priority Data

Sep. 10, 1985 [JP] Japan ..... 60-199692

[51] Int. Cl.[4] ..... H05H 13/00

[52] U.S. Cl. ..... 328/233; 328/235; 313/62; 250/492.1

[58] Field of Search ..... 328/233, 235; 313/62; 250/492.1, 492.2

[56] References Cited

FOREIGN PATENT DOCUMENTS 52-50317 11/1977 Japan .
60-115200 6/1985 Japan .

*Primary Examiner*—David K. Moore
*Assistant Examiner*—K. Wieder
*Attorney, Agent, or Firm*—Burns, Doane, Swecker & Mathis

[57] ABSTRACT

In an electron beam accelerator of the type that electrons are guided into an equilibrium orbit through an inflector and radiant light is generated by accelerating the electrons on the equilibrium orbit, there is provided a drive section for moving the inflector in the directions perpendicular to the plane defined by the equilibrium orbit, and by making use of this drive section the inflector is made to retire from the radiant light. By making the inflector retire, radiant light can be derived also through the position of the inflector, and also, since the inflector is not irradiated by the radiant light, attention of the radiant light caused by lowering of a degree of vacuum can be prevented.

5 Claims, 2 Drawing Sheets

ELECTRIC BEAM ACCELERATOR

TECHNICAL FIELD

The present invention relates to an electron beam accelerator in which radiant light is obtained by accumulating high energy through the process of making electrons injected from an injector revolve along an equilibrium orbit.

BACKGROUND TECHNIQUE

Heretofore, among such type of electron beam accelerators the so-called weak convergence type electron synchrotron has been known. In the weak convergence type synchrotron, an inflector for guiding an incident electron beam onto an equilibrium orbit and an accelerating electrode for accelerating electrons on an equilibrium orbit are disposed within a magnetic field, and thereby it is attempted to reduce the size of the entire apparatus. Such weak convergence type synchrotrons can be utilized as lithography beam sources or the like by externally deriving radiant light generated by electrons on an equilibrium orbit.

However, in the case where an inflector and an accelerating electrode are disposed within a magnetic field, there is a shortcoming that a radiant light derivable scope in which radiant light can be externally derived is limited. Furthermore, since normally a beam diagnostic apparatus, a vacuum instrument and the like are also disposed in the radiant light derivable scope, partially the position where radiant light can be derived is limited to a very one part of the radiant light derivable scope.

One object of the present invention is to provide an electron beam accelerator in which the scope of the radiant light is enlarged so that the radiant light can be derived efficiently.

DISCLOSURE OF THE INVENTION

According to the present invention, there is provided an electron beam accelerator of the type that it can derive radiant light generated by revolving electrons along an equilibrium orbit and also it is provided with an inflector for guiding electrons to the equilibrium orbit, which comprises drive means for driving the inflector in the directions perpendicular to the plane defined by the equilibrium orbit to make the inflector retire to a position where the radiant light may not strike the inflector.

According to the present invention, it has been found that an inflector is necessary only when electrons are injected, it is unnecessary when electrons are accelerated, and rather it becomes an obstacle for radiant light when the radiant light is utilized, and thereby there is provided an electron beam accelerator in which an inflector is made to retire to a position where radiant light may not strike the inflector upon utilization of the radiant light so that the radiant light can be derived also from the scope of the inflector. By sheltering an inflector from radiant light in the above-described manner, adverse effects caused by radiant light striking an inflector, can be also eliminated.

THE BEST MODE FOR EMBODYING THE INVENTION

Figure 1:
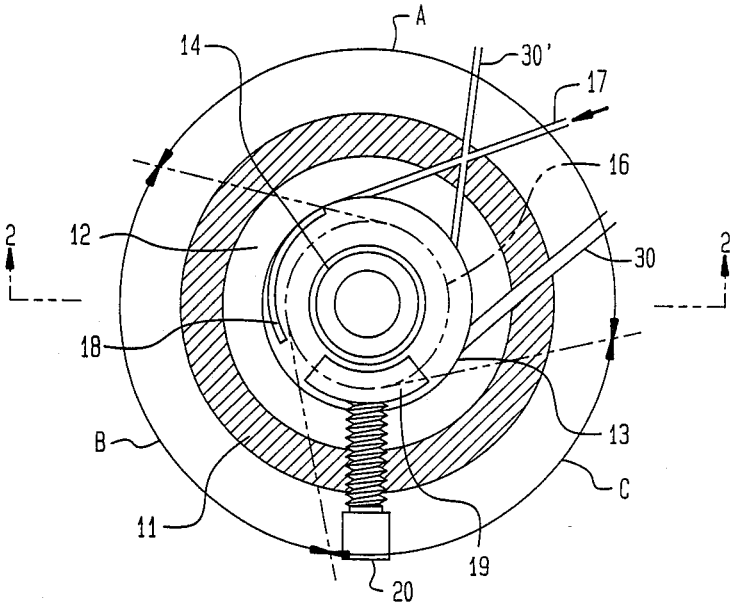
FIG. 1 is a plan cross-section view for explaining an electron beam accelerator to which the present invention is applicable.
Figure 2:
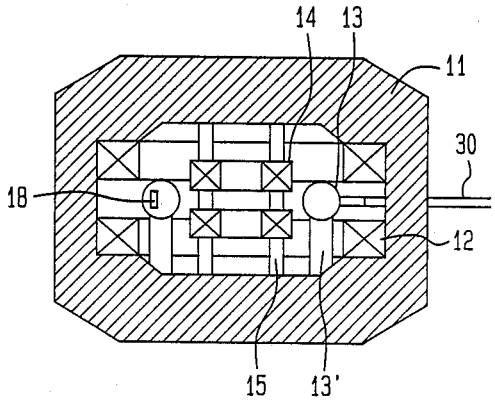
FIG. 2 is a cross-section view taken along line 2—2 in FIG. 1.

In order to facilitate understanding of the present invention, at first description will be made on an electron beam accelerator in the prior art with reference to FIGS. 1 to 4. In FIGS. 1 and 2 is shown a weak convergence type electron synchrotron as an electron beam accelerator. The illustrated synchrotron comprises an iron core 11 which defines a hollow space on its inside, and a pair of coils 12 are disposed along the inner wall of the iron core 11. In addition, within the hollow space is positioned a toroidal vacuum duct 13, the vacuum duct 13 is supported by support stands 13', and the vacuum duct 13 is held at a vacuum state by means of a vacuum pump (not shown). Furthermore, within the inner space surrounded by the vacuum duct 13 are disposed another pair of coils 14, and the coils 14 are supported by support stands 15. Here, within the vacuum duct 13 is formed an equilibrium orbit, that is, a revolving orbit 16 of electrons, and the coils 12 and 14 generate magnetic fields in the directions perpendicular to the plane defined by the equilibrium orbit 16.

Into the vacuum duct 13 are shot electrons accelerated by an injector (not shown) through an incident beam line 17. The shot electrons can not trace the same locus as the equilibrium orbit 16 within the vacuum duct 13, if they are kept intact. This is because the injected electrons would depict loci having the same radius of curvature as the equilibrium orbit 16 before they reach onto the equilibrium orbit 16.

Therefore, in order to guide the shot electrons onto the equilibrium orbit 16 while increasing their radius of curvature, within the vacuum duct 13 is disposed an inflector 18. Furthermore, for the purpose of accelerating the electrons to a high energy level, an accelerating electrode 19 is positioned in the proximity of the inflector 18 in the vacuum duct 13, and the accelerating electrode 19 is connected to a high frequency oscillator.

Figure 3:
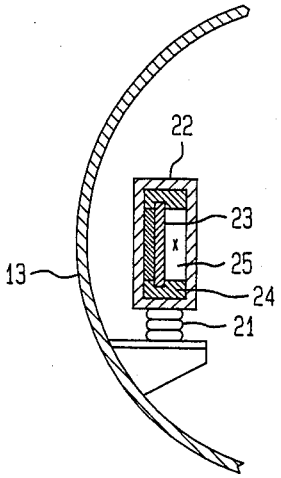
FIG. 3 (PRIOR ART)
FIG. 3 a cross-section view showing one example of an inflector in the prior art which is available in the electron beam accelerator shown in FIGS. 1 and 2.

Referring to FIG. 3, there is illustrated a magnetic field type inflector in the prior art which can be used as the inflector 18 in FIGS. 1 and 2. The magnetic field type inflector in the prior art is mounted within the vacuum duct 13 via an insulating material 21. More particularly, the illustrated magnetic field type inflector includes an outer conductor 22 having a rectangular cross-section shape and mounted on an insulating material 21, and an inner conductor 23 disposed inside of the outer conductor 22, the inner conductor 23 is fixed inside of the outer conductor 22 via an insulating material 24, and between the inner conductor 23 and the outer conductor 22 is formed a gap 25. The inner conductor 23 and the outer conductor 22 are electrically connected at their one ends, and the other ends are connected to a D.C. power supply (not shown). As a result, currents flow through the outer conductor 22 and the inner conductor 23 in the opposite directions to each other, and hence a magnetic field is formed within the gap 25. Accordingly, the magnetic field within the vacuum duct 13 is weakened by the magnetic field in the gap 25, and radii of curvature of electrons passing through the gap 25 as shown by mark X can be made large. Consequently, the shot electrons can be placed on the equilibrium orbit.

Figure 4:
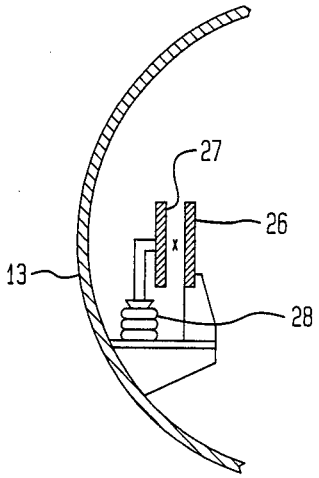
FIG. 4 (PRIOR ART)
FIG. 4 is a cross-section view showing another example of an inflector in the prior art.

Referring to FIG. 4, a magnetic field type inflector in the prior art includes a pair of opposed electrode plates 26 and 27, one electrode plate 26 is grounded and the other electrode plate 27 is applied with a high voltage. In view of this relation, the electrode plate 27 is electrically insulated from the electrode plate 26 by an insulator 28.

Returning now to FIG. 1, in the case where the inflector 18 and the accelerating electrode 19 are diposed within the vacuum duct 13, a scope through which radiant light can be derived (a derivable scope) would become extremely narrow. More particularly, radiant light is generated in the tangential direction of the equilibrium orbit, and if there is no obstacle in this direction, the radiant light can be derived externally. With reference to FIG. 1, only a scope A that is defined by the inlet side of the inflector 18 and the outlet side of the accelerating electrode 19, serves as a derivable scope of radiant light, and in the other scopes B and C, the radiant light can not be derived due to the inflector 18 and the accelerating electrode 19.

Accordingly, a light duct 30 for deriving light is disposed within the scope A. However, even in the scope A, in the event that a light duct 30' is disposed at a position intersecting with the injecting beam line 17, any special device is necessitated. Since this device is irrelevant to the essence of the present invention, here it will be not described in more detail.

Furthermore, in the illustrated electron beam accelerator, the inflector 18 is irradiated by the radiant light. This implies that after shooting of electrons if radiant light is generated, the inflector 18 would become an obstacle. In general, if radiant light strikes an obstacle, a large amount of gas is produced by sputtering phenomena, resulting in loss of electrons, and so, existence of the inflector 18 would adversely affect also the aspect of performance. It is to be noted that in practice, since a beam diagnostic apparatus and a vacuum instrument are mounted within the scope A, the derivable scope for the radiant light is limited to one part of the scope A.

PREFERRED EMBODIMENTS OF THE INVENTION

Figure 5:
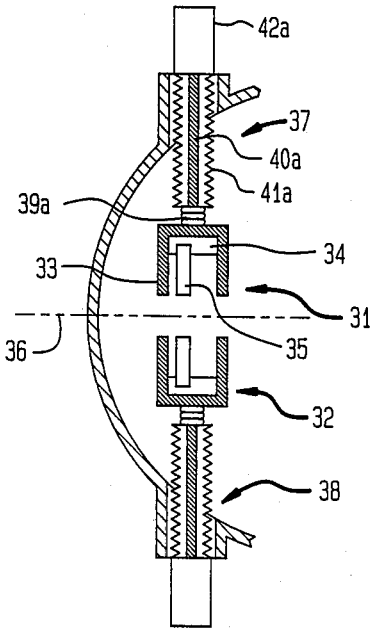
FIG. 5 is a cross-section view for explaining an inflector according to one preferred embodiment of the present invention.

Referring now to FIG. 5, there is illustrated a magnetic field type inflector according to on preferred embodiment of the present invention, which is available as the inflector 18 in FIGS. 1 and 2.

The inflector in FIG. 5 is severed into a first inflector section 31 and a second inflector section 32, each of the inflector sections 31 and 32 includes an outer conductor 33 having a U-shaped cross-section and an inner conductor 35 fixed inside of the outer conductor 33 via an insulator 34, the outer conductor 33 and the inner conductor 35 of each of the inflector sections 31 and 32 are electrically connected to each other at one ends, and the other ends of the outer conductor 33 and the inner conductor 35 are connected to a D.C. power supply. The D.C. power supply could be provided either in common to the first and second inflector sections 31 and 32 or individually for each inflector section 31 or 32.

The first and second inflector sections 31 and 32 are mounted to drive sections 37 and 38, respectively, so that they can be moved in the perpendicular directions with respect to a plane 36 defined by the equilibrium orbit (hereinafter called "neutral plane"). As will be readily seen from FIGS. 1 and 5, the respective drive sections 37 and 38 move the respective inflector sections 31 and 32 in the directions at right angles to the travelling direction of the radiant light.

The illustrated drive sections 37 and 38 have the same structure, and each of them includes an insulating material **39*a* for supporting the outer conductor 33, a drive rod 40*a* connected to this insulating material 39*a*, vacuum bellows 41*a* covering the drive rod 40*a*, and an air cylinder 42*a* for driving the drive rod 40*a***.

Figure 6:
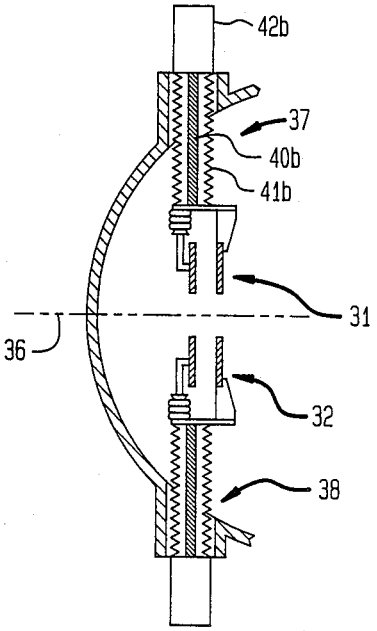
FIG. 6 is a cross-section view for explaining an inflector according to another preferred embodiment of the present invention.

Referring now to FIG. 6, an inflector according to another preferred embodiment of the present invention is an electric field type inflector, and this electric field type insulator is also severed into first and second inflector sections 31 and 32. Each of the inflector sections 31 and 32 is constructed of a pair of opposed electrode plates spaced from each other.

Similarly to the case shown in FIG. 4, one of the par of electrodes is grounded and the other is held at a high voltage. Each of the inflector sections 31 and 32 is, similarly to FIG. 5, driven by a drive section 37 or 38 having a drive rod **40*b* covered by vacuum bellows 41*b* and an air cylinder 42*b***.

The drive sections 37 and 38 in FIGS. 5 and 6 have drive the first and second inflector sections 31 and 32, respectively, but since the height of the radiant light on the neutral plane 36 is only several millimetres, only either one of the first and second inflector sections 31 and 32 could be moved in the upper or lower direction by means of the drive section.

Furthermore, by raising or lowing the entire inflector 18 from the neutral plane 36 without severing the inflector 18 into two sections, the inflector 18 can be made to retire from the radiant light.

In FIG. 1, it is assumed that electrons have been injected from the injector through the incidence beam line 17 with energy of about 100 MeV. Under this condition, the first and second inflector sections 31 and 32 shown in FIG. 5 or 6 are held in contact with each other, and so similarly to FIG. 3 or 4, electrons are guided to the equilibrium orbit 16 via the inflector 18. If the magnetic field intensity or the electric field intensity is increased in accordance with increase of electron energy caused by the accelerating electrode 19, then the electrons generate synchrotron radiant light in the tangential direction while they are revolving along the equilibrium orbit 16. At this time point, as shown in FIGS. 5 and 6, the first and second inflector sections 31 and 32 are separated from the neutral plane by driving the drive sections 37 and 38. Thereby the radiant light can be released externally without striking the inflector 18.

Accordingly, radiant light can be derived not only from the scope A in FIG. 1, but also from the scope B, and so, the drivable scope of radiant light can be widely enlarged.

Thereafter, at the time point when the electron energy has reached several hundreds MeV lGeV, the energy is maintained and generated radiant light can be utilized for research of properties of materials and manufacture of semiconductors.

According to the present invention, since the inflector is made movable so that it can retire to a position where radiant light does not strike it, the scope of utilization of radiant light can be greatly broadened. Especially, since this portion is located at such position that it does not interfere an incident beam line, the invention is advantageous in view of beyond of the apparatus. Furthermore, as the radiant light does not strike the inflector, extension of a life of an accumulated beam caused by improvements in a degree of vacuum as well as saving of an evacuation capacity can be achieved.

POSSIBILITY OF INDUSTRIAL UTILIZATION

The electron beam accelerator according to the present invention can be applied to a lithography beam source in manufacture of semiconductors, an X-ray microscope, medical diagnosis, and the like by making use of the generated radiant light.

I claim:

1. An electron beam accelerator which can derive radiant light generated by revolving electrons inflector for guiding electrons to said equilibrium orbit; characterized in that said accelerator comprises drive means for driving said inflector in the directions perpendicular to the plane defined by said equilibrium orbit, and that said inflector can retire to a position where said radiant light may not strike it owing to said drive means.

2. An electron beam accelerator as claimed in claim 1, characterized in that said inflector is severed into a first inflector section and a second inflector section, and said drive means includes first and second partial drive means for respectively driving the first and second inflector sections in the directions perpendicular to the plane defined by said equilibrium orbit.

3. An electron beam accelerator as claimed in claim 1, characterized in that said drive means can move said inflector to the above and to the below of the plane defined by said equilibrium orbit.

4. An electron beam accelerator as claimed in claim 1, characterized in that said inflector guides said electrons onto the equilibrium orbit by generating a magnetic field.

5. An electron beam accelerator as claimed in claim 1, characterized in that said inflector guides said electrons onto the equilibrium orbit by generating an electric field.

* * * * *